US005087214A

United States Patent [19]

Dewar

[11] Patent Number: 5,087,214

[45] Date of Patent: Feb. 11, 1992

[54] BATTERY TERMINAL CONNECTOR

[75] Inventor: John H. Dewar, Grosse Ile, Mich.

[73] Assignee: United Technologies Automotive, Inc., Dearborn, Mich.

[21] Appl. No.: 703,523

[22] Filed: May 21, 1991

[51] Int. Cl.[5] ..... H01R 4/42

[52] U.S. Cl. ..... 439/762; 439/388; 439/761; 439/765; 29/862

[58] Field of Search ..... 439/388, 756, 761, 762, 439/765, 766, 803, 815; 29/862, 861

[56] References Cited

U.S. PATENT DOCUMENTS

| | | | |
|---|---|---|---|
| Re. 18,451 | 5/1932 | Weimer et al. | 439/388 |
| 1,714,762 | 5/1929 | Bone | 439/762 |
| 1,750,501 | 3/1930 | Armstrong | 439/388 |
| 3,568,138 | 3/1971 | Bakker | 439/762 |
| 3,694,799 | 9/1972 | Shannon et al. | 439/762 |
| 4,099,827 | 7/1978 | Webster | 439/761 |

FOREIGN PATENT DOCUMENTS

| | | | |
|---|---|---|---|
| 0060998 | 9/1982 | European Pat. Off. | 439/762 |
| 1246845 | 8/1967 | Fed. Rep. of Germany | 439/762 |
| 0940756 | 12/1948 | France | 439/762 |
| 0698102 | 11/1985 | Italy | 439/765 |
| 7705612 | 11/1978 | Netherlands | 439/388 |
| 2054984 | 2/1981 | United Kingdom | 439/762 |

*Primary Examiner*—Paula A. Bradley
*Attorney, Agent, or Firm*—Ronald G. Cummings

[57] ABSTRACT

A battery post connector having a body member formed from sheet metal comprising a clamp section for attachment to a terminal post and a base section for rigid connection to a battery cable. The clamp section has an inner surface adapted to grippingly engage a battery post to inhibit angular rotation and includes elongated slots disposed oblique to the central axis of the battery post with opposite edges adapted to penetrate the battery post and a coined pattern extending adjacent and parallel to the slots. The terminal is clamped to the battery post by a nut and bolt assembly with the nut being force fit mounted to the clamp section for good electrical continuity therewith and heat sink characteristics and the bolt having a captured bolt head for positive mechanical opening of the connector.

23 Claims, 2 Drawing Sheets

BATTERY TERMINAL CONNECTOR

TECHNICAL FIELD

This invention relates to terminal connectors for storage batteries and more particularly to a stamped metal battery post connector for automobile storage batteries and the like.

BACKGROUND AND SUMMARY OF THE INVENTION

Storage batteries of the type used in automobiles, trucks and the like generally have terminal posts made of lead alloy material with a cylindrical or frusto-conical shape. A conventional connector used with such battery posts is a molded, generally U-shaped device with a bolt passing through the outwardly projecting yoke-like arms for securely clamping the connector to the battery post. Exemplary connectors are shown in Waltz, U.S. Pat. No. 1,808,330, Haegert, U.S. Pat. No. 26,486 and Anderson, U.S. Pat. No. 2,713,155. Such connectors are generally die cast from lead or brass-lead alloy or other materials such as zinc alloy or copper alloy.

Another type of connector is a stamped metal battery terminal connector which is fabricated from sheet metal. Exemplary stamped metal connectors are shown in Kato et al., U.S. Pat. No. 4,354,726, Kourimsky et al., U.S. Pat. No. 4,054,355 and Bakker, U.S. Pat. No. 3,568,138 which are incorporated herein by reference. Stamped terminal connectors are generally preferable where weight reduction is a major consideration.

In such connectors, it is desirable to achieve a secure mechanical connection which resists angular rotation and maintains good electrical continuity with the battery post.

Accordingly, it is an object of the present invention to provide a new and improved stamped metal battery terminal connector which achieves good mechanical and electrical connection to the battery post with enhanced resistance to angular rotation.

Another object of the invention is to provide such a connector which affords positive mechanical opening for easy and convenient disconnection from the battery post.

A further object of the invention is to provide such a connector with improved current carrying and heat generating characteristics.

A still further object of the invention is to provide such a connector which is cost efficient to manufacture and adapted for automated assembly.

It has been found that the foregoing and related objects are attained in a battery post connector having a body member formed from sheet metal and comprising a clamp section for attachment to a terminal post of a storage battery and a base section for rigid connection to a battery cable. The clamp section is configured to extend around the battery post and has first and second ends such that drawing the ends together compresses the clamp section about the battery post to clamp the connector to the post. The clamp section has an inner surface adapted to grippingly engage the battery post so as to inhibit angular rotation of the connector about the battery post. The inner surface of the clamp section has an elongated slot with opposite edges adapted to penetrate the battery post with the edges being oblique to the central axis of the battery post when the clamp section is clamped thereto. The inner surface also has a coined pattern extending about the battery post and configured to penetrate the post when the clamp section is clamped thereto. A threaded connector is adapted for drawing together the first and second ends of the clamp section to clamp the battery connector to the post.

In a preferred embodiment, the coined pattern comprises a plurality of coined recesses. The coined recesses are arranged in a linear array generally oblique to the central axis of the battery post. The linear array may be parallel to the slot. The slot may comprise first and second spaced slot sections.

In a further embodiment, the threaded fastener includes a nut and bolt with the nut being force fit mounted within an aperture in the clamp section so as to provide good electrical continuity between the nut and clamp section. The nut is configured for displacing the sheet metal material of the clamp section into locking engagement with the nut during force fit mounting. The bolt head has an annular flange and the clamp section has tabs positioned to retentively engage the annular flange to capture the bolt head against the clamp section yet allow angular rotation of the bolt head. With a captured bolt head, angular rotation of the bolt to disengage the bolt and nut separates the ends of the clamp section to expand the clamp section.

DESCRIPTION OF THE PREFERRED EMBODIMENT

Figure 2:
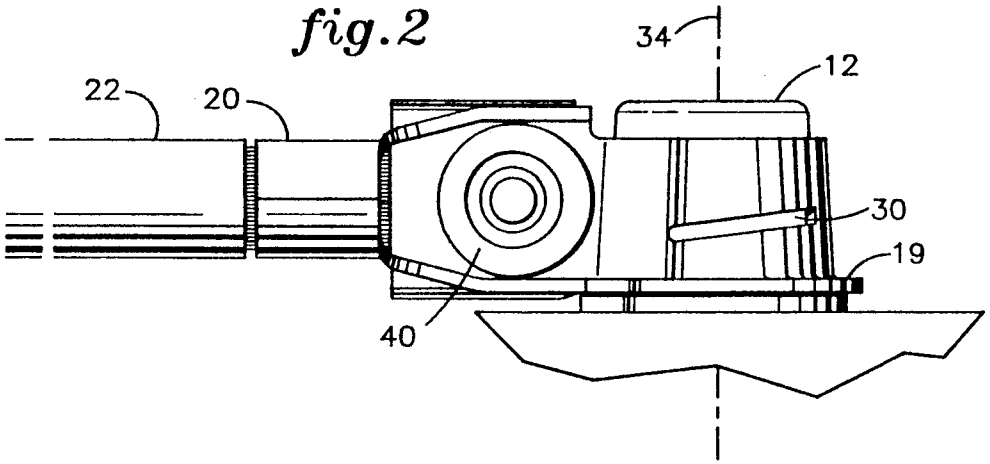
FIG. 2 is an opposite side view of the connector of FIG. 1 mounted to a battery post.

Although specific forms of the present invention have been selected for illustration in the drawings, and the following description is drawn in specific terms for the purpose of describing these forms of the invention, the description is not intended to limit the scope of the invention which is defined in the appended claims.

Figure 1:
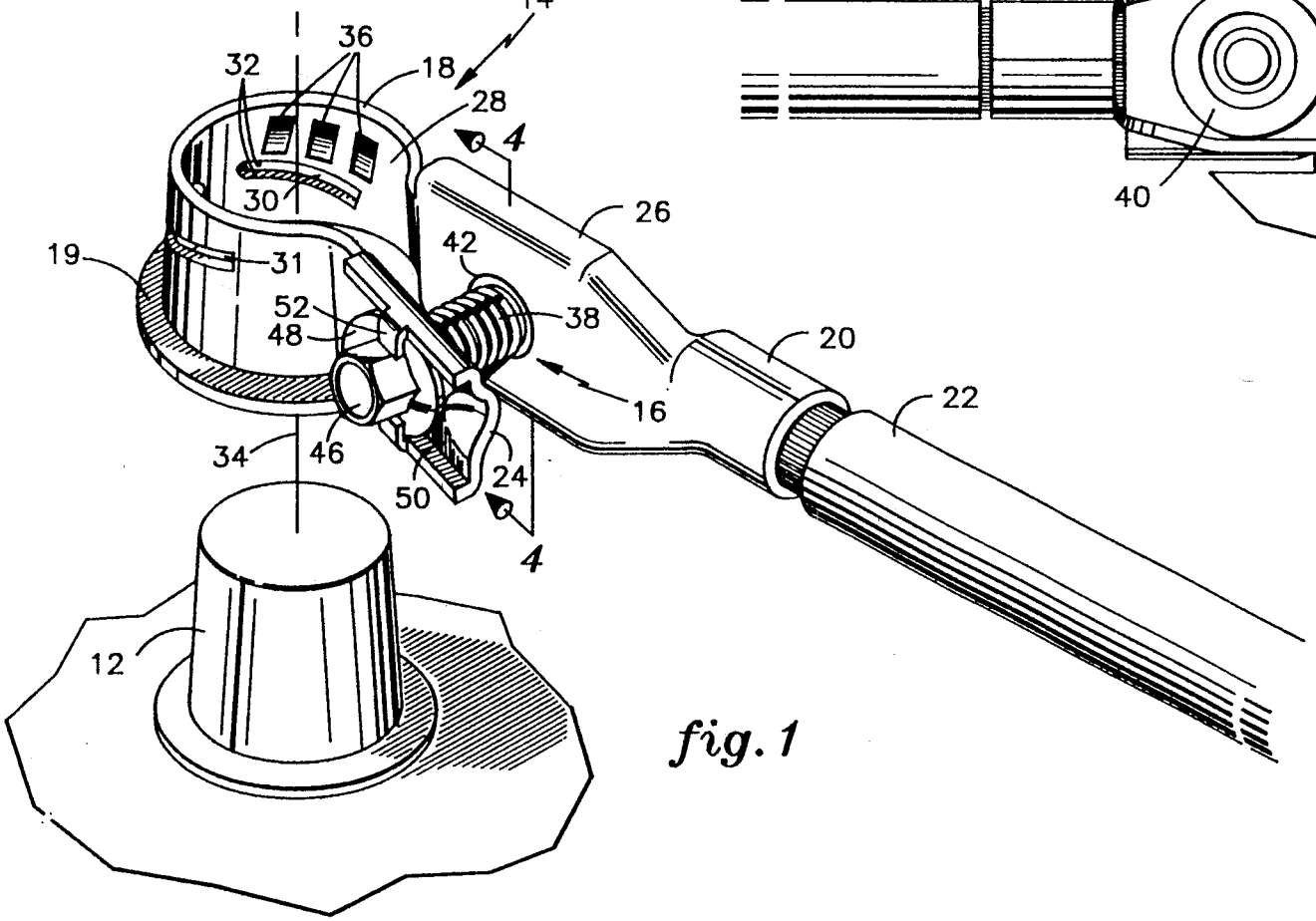
FIG. 1 is a perspective view of the battery post connector of the present invention and a battery post.
Figure 3:
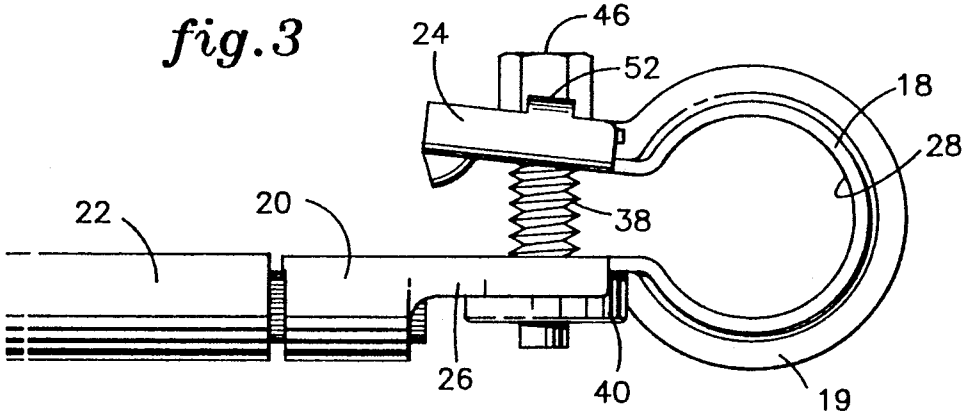
FIG. 3 is a top view of the connector of FIG. 1.

Referring to FIG. 1, the battery terminal connector of the present invention is shown in an open position ready for mounting on a battery post 12. The connector generally comprises a body member 14 formed from a single piece of sheet metal and a threaded fastener assembly 16. The body member 14 is formed into a clamp section 18 for attachment to the battery post 12 and a base or ferrule section 20 for crimp connection to the battery cable 22.

The clamp section 18 is generally cylindrical or slightly frusto-conical in shape to encircle and clamp to the battery post 12. The clamp section 18 has opposed elongated end tabs 24, 26 for mounting the threaded fastener 16 such that drawing the end tabs 24, 26 together compresses the clamp section 18 about the post 12 to clamp the connector thereto. The clamp section 18 is dimensioned relative to the battery post 12 so as to slide over the post in the open position of FIG. 1 and to tightly clamp thereto when end tabs 24, 26 are drawn together. A flange 19 along the bottom of clamp section 18 facilitates mounting the connector over post 12.

The inner surface 28 of clamp section 18 is configured to grippingly engage the battery post 12 to substantially inhibit or prevent angular rotation of the connector about the battery post. The clamp section 18 has two aligned elongated slots 30 which form opposed longitudinal edges 32 on the inner surface 28. The edges 32 are adapted to penetrate the battery post 12 when the clamp section 18 is clamped thereto. As best seen in FIG. 2, the slots 30 (and thus the edges 32) are oblique to the center axis 34 and extend more than 180° around the post 12. When the clamp section 18 is clamped to the battery post, the edges 32 penetrate slightly the battery post such that metal material of the post enters the slots 30 and the non-perpendicular (i.e., oblique) orientation of slots 30 relative to center axis 34 will provide an enhanced resistance to angular rotation. Alternately, a single slot extending about the battery post in the same orientation as slots 30 may be utilized.

The inner surface 28 also has a coined pattern for penetrating and grippingly engaging the battery post. Coining is a known technique which will produce recesses with defined edges in the inner surface without removing material. In the illustrated embodiment, the coined pattern comprises a linear array of spaced coined rectangular recesses 36 extending adjacent the slot 30 and a similar array extending adjacent the slot 31. In the orientation of clamp section 18 as viewed in FIG. 1, an array of recesses 36 is disposed above slot 30 and parallel thereto. A second array of recesses (not shown in FIG. 1) is disposed below slot 31 and parallel thereto. Consequently, each linear array is generally oblique to the central axis 34 when the clamp section 18 is secured to the battery post.

When the clamp section 18 is clamped to the battery post, the edges of the coined recesses 36 will penetrate the post such that the material of the post will enter the recesses to provide good electrical continuity with the connector. The linear arrays of recesses are at a nonorthogonal angle (i.e., oblique) relative to the central axis 34 to provide enhanced resistance to angular rotation. It is believed that the nonorthogonal orientation of the coined pattern significantly increases the resistance to angular rotation. Alternate patterns may be acceptable although coined recesses are preferable. Coining does not remove material from the connector and therefore maximizes the current carrying capability of the connector.

The threaded fastener assembly 16 comprises a bolt 38 and nut 40 mounted to the end tabs 24, 26 for drawing the tabs 24, 26 together to compress the clamp section 18 about the post 12 and conversely for separating the tabs 24, 26 to remove the connector therefrom.

Figure 4:
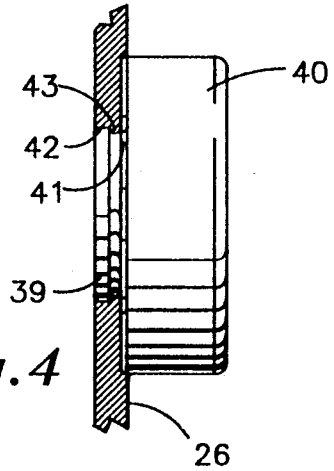
FIG. 4 is a section view seen on line 5—5 of FIG. 1 with the bolt removed.

Referring to FIG. 4, the nut 40 is force fit mounted within an aperture 42 in end tab 26. The nut 40 is a conventional type and is configured to displace the sheet metal material of the end tab 26 into locking engagement with the nut to provide structural integrity as well as good electrical continuity between the nut 40 and the end tab 26. The nut 40 comprises a sizing ring 39, displacement lobes 41 and a retaining groove 43. As the nut 40 is fed into the aperture 42, the sizing ring 39 automatically rounds and sizes the aperture 42 to the required diameter. When pressure is applied, the displacement lobes 41 are seated thereby forcing engaging material of the end tab 26 into the retaining groove 43 for a rotation-resistant assembly. Such nuts are commercially sold under the trademark STRUX by the Camcar Division of Textron, Inc., Rochester, Ind.

The nut 40 is preferably steel and its tight, force fit mounting within aperture 42 contributes to the advantageous current carrying and heat generation characteristics of the connector. The good electrical continuity between the nut 40 and the end tab 26 minimizes resistance so that less heat is generated. Further, the added metal mass of the nut 40 improves heat dissapation resulting in lower running operating temperature. Accordingly, the nut 40 contributes to the current carrying capability of the connector and also functions as a heat sink.

The bolt 38 extends through an aperture 44 in end tab 24 with the bolt head 46 positioned outwardly of end tab 24. The bolt head 46 has an annular flange 48 adjacent the outer surface 50 of end tab 24. End tab 24 has opposed retaining tabs 52 bent over annular flange 48. The retaining tabs 52 retain or capture the bolt head 46 adjacent end tab 24 yet allow angular rotation of the bolt 38 for clamping and unclamping the connector. The retention of bolt head 46 against end tab 24 results in an automatic opening or spreading of clamp section 18 upon rotating the bolt 38 toward disengagement from the nut 40, i.e., counterclockwise as viewed in FIG. 1. Upon so rotating the bolt to withdraw from nut 40, the end tabs 24, 26 are driven apart to open up the clamp section 18 for easy removal from the battery post 12.

Figure 5:
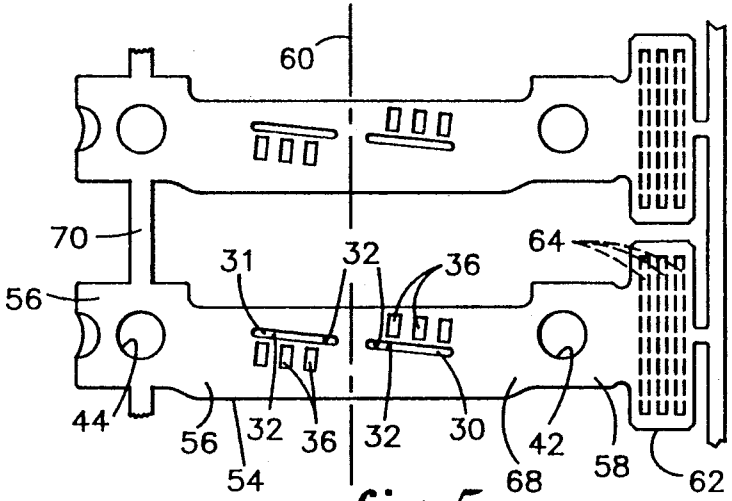
FIG. 5 shows a blank strip for forming the connector of FIG. 1.

As can be seen, the connector of the present invention is formed from a single piece of sheet metal except for the bolt 38 and nut 40. In the illustrated embodiment, the connector is made of UNS C26000 brass with a tin plating. The blank for the body member of the connector as stamped from sheet metal is shown in FIG. 5. The blank comprises an elongated central web 54 with opposite end tab sections 56, 58 equi-spaced from the central transverse axis 60 of web 54. The end tab section 58 has an aperture 42 for mounting nut 40 while end tab section 56 has a bolt receiving aperture 44. A generally rectangular ferrule tab 62 is formed at the outer end of end tab section 58 and extends axially parallel to the transverse axis 60. The ferrule tab 62 has a plurality of grip serrations 64 extending parallel to the transverse axis 60.

For purposes of description, the web section 54 is divided into an upper section 66 being that portion above the transverse axis 60 as viewed in FIG. 5 and a lower section 68 being that portion below the transverse axis 60. The upper section 56 has an elongated through-slot 31 generally oblique to the transverse axis 60. In the illustrated embodiment, the angle of slot 31 relative to axis 60 is approximately 84 degrees. The lower section 68 has a similar slot 30 in alignment with slot 31. The slots 30, 31 are generally equidistant from the transverse axis 60. A first linear array of coined rectangular recesses 36 is disposed adjacent and parallel to slot 31 and a second linear array of recesses 36 is disposed adjacent and parallel to slot 30. The linear arrays of recesses are generally equidistant from the center axis 60. The blanks 54 are joined to each other by tabs 70 which are easily broken to separate the connectors.

In connecting the connector of the present invention to a battery post, the clamp section 18 is first placed over the battery post 12 in the open position as shown in FIG. 1. The bolt 38 is rotated to draw the end tabs 24, 26 together to reduce the diametral opening of clamp section 18 and compress section 18 about the battery post. The bolt 38 is rotated until the clamp section 18 is securely clamped to the post 12. In the clamped position, the edges of the coined recesses 36 and the edges of the slots 30, 31 penetrate the battery post 12 such that the material of the battery post will enter the recesses and slots to provide good electrical continuity with the connector. The slots 30, 31 and the line ar arrays of recesses are at an oblique angle relative to the center axis 34 of the battery post so as to provide enhanced resistance to angular rotation. It is believed that this nonorthogonal orientation significantly increases the resistance to angular rotation. To remove the connector from the terminal for service, bolt 38 is rotated to draw apart the end tabs 24, 26 and automatically break away the clamp section 18 from the battery post 12 to allow convenient disconnection and removal.

As can be seen, a stamped metal battery terminal connector has been described which achieves good mechanical and electrical connection to the battery post with enhanced resistance to angular rotation. The connector affords positive mechanical opening for easy and convenient disconnection from the battery post. Furthermore, the connector exhibits enhanced current carrying and heat generating characteristics and is cost-efficient to manufacture.

As will be apparent to persons skilled in the art, various modifications and adaptations of the structure above described will become readily apparent without departure from the spirit and scope of the invention, the scope of which is defined in the appended claims.

What is claimed is:

1. A battery post connector comprising:

(a) a body member formed from sheet metal comprising a clamp section for attachment to a terminal post of a storage battery and a base section for rigid connection to a battery cable;

(b) said clamp section being configured to extend around the battery post and having first and second ends such that drawing said ends together compresses said clamp section about said post to clamp the battery post connector to said battery post;

(c) said clamp section having an inner surface adapted to grippingly engage a battery post to inhibit angular rotation of the battery post connector about the battery post, (d) said inner surface having (1) an elongated slot with an edge adapted to penetrate said battery post, said edge being oblique to the central axis of said battery post when the clamp section is clamped to the battery post, and (2) a coined pattern disposed to extend about said battery post and being configured to penetrate said battery post when the clamp section is clamped to the battery post; and (e) means for drawing together said first and second ends of said clamp section to clamp the battery connector to a battery post.

2. The battery post connector of claim 1 wherein said slot comprises first and second spaced slot sections.

3. The battery post connector of claim 1 wherein said slot has a second opposite edge adapted to penetrate said battery post and being oblique to the central axis of said battery post when the clamp section is clamped to the battery post.

4. The battery post connector of claim 1 wherein said coined pattern comprises a plurality of coined recesses.

5. The battery post connector of claim 4 wherein said recesses are rectangular.

6. The battery post connector of claim 1 wherein said coined pattern comprises a linear array of coined recesses.

7. The battery post connector of claim 6 wherein said linear array is disposed adjacent said slot.

8. The battery post connector of claim 6 wherein said linear array is generally oblique to the central axis of said battery post when the clamp section is clamped to the battery post.

9. The battery post connector of claim 8 wherein said linear array is generally parallel to said slot.

10. The battery post connector of claim 1 wherein said means for drawing together said first and second ends of said clamp section comprises a nut and a bolt, said first end of said clamp section has a first aperture for receiving said bolt, and said second end of said clamp section has a second aperture with said nut being force fit mounted within said second aperture so as to provide good electrical continuity between said nut and said clamp section.

11. The battery post connector of claim 10 wherein said nut is configured for displacing sheet metal material of said second end of said clamp section into locking engagement with said nut during force fit mounting of said nut within said second aperture.

12. The battery post connector of claim 10 wherein said base section is integrally formed to said second end of said clamp section.

13. The battery post connector of claim 10 wherein said bolt has a bolt head and said first end of said clamp section comprises means for rotatably mounting said bolt head adjacent said first end so that angular rotation of said bolt to withdraw said bolt from said nut withdraws said first end of said clamp section from said second end of said clamp section.

14. The battery post connector of claim 13 wherein said bolt head has an annular flange and said first end of said clamp section has tabs positioned to retentively engage said annular flange to retain said bolt head against said first end while permitting angular rotation of said bolt head.

15. A battery post connector comprising:

(a) a body member formed from sheet metal comprising a clamp section for attachment to a terminal post of a storage battery and a base section for rigid connection to a battery cable;

(b) said clamp section being configured to encircle the battery post and having first and second ends such that drawing said ends together compresses said clamp section about said post to clamp the battery post connector to said battery post, said first end having a first aperture for receiving a bolt and said second end having a second aperture for mounting a nut;

(c) said clamp section having an inner surface adapted to grippingly engage a battery post to inhibit angular rotation of the battery post connector about the battery post; and (d) means for drawing together said first and second ends of said clamp section to clamp the battery connector to a battery post, said means comprising a nut force fit mounted within said second aperture so as to provide good electrical continuity between said nut and said clamp section and a bolt extending through said first aperture for threaded engagement with said nut.

16. The battery post connector of claim 15 wherein said nut is configured for displacing sheet metal material of said second end of said clamp section into locking engagement with said nut during force fit mounting of said nut within said second aperture.

17. The battery post connector of claim 15 wherein said bolt has a bolt head and said first end of said clamp section comprises means for rotatably mounting said bolt head adjacent said first end so that angular rotation of said bolt to withdraw said bolt from said nut withdraws said first end of said clamp section from said second end of said clamp section.

18. The battery post connector of claim 17 wherein said bolt head has an annular flange and said first end of said clamp section has tabs positioned to retentively engage said annular flange to retain said bolt head against said first end while permitting angular rotation of said bolt head.

19. A blank for a battery post connector stamped from sheet metal comprising an elongated web with first and second opposite ends and a transverse center axis, first and second end tabs formed respectively at said first and second opposite ends, said first end having a first aperture and said second end having a second aperture, and said web having opposed top and bottom surfaces with a coined pattern and a slot in said top surface extending oblique to said center axis.

20. The blank of claim 19 wherein said coined pattern comprises a linear array of coined rectangular recesses extending oblique to said center axis.

21. The blank of claim 19 wherein a ferrule tab is formed adjoining said second end tab and having opposed top and bottom surfaces, said ferrule tab having a plurality of elongated gripping serrations in said second bottom surface.

22. The blank of claim 19 wherein said web has a second slot in said top surface aligned with said first slot so as to be oblique to said center axis and said coined pattern comprises a first linear array of coined recesses parallel to said first slot and a second array of coined recesses parallel to said second slot.

23. The blank of claim 22 wherein said first and second slots and said first and second arrays are equispaced from said center axis.

* * * * *

UNITED STATES PATENT AND TRADEMARK OFFICE

CERTIFICATE OF CORRECTION

PATENT NO. : 5,087,214

DATED : February 11, 1992

INVENTOR(S) : JOHN H. DEWAR

It is certified that error appears in the above-identified patent and that said Letters Patent is hereby corrected as shown below:

In the References Cited, Under "U.S. PATENT DOCUMENTS", add the following:

| | | | |
|---|---|---|---|
| 1,661,375 | 3/1928 | Leighton | 339/230 |
| 1,667,581 | 4/1928 | Bailey | 439/775 |
| 1,676,387 | 7/1928 | De Lorme | 439/762 |
| 1,691,079 | 11/1928 | Nightingale | 439/756 |
| 1,813,829 | 7/1931 | Vaccaro | 439/768 |
| 1,837,814 | 12/1931 | Grunwald | 439/758 |
| 1,914,998 | 6/1933 | Looker | 439/758 |
| 1,920,608 | 8/1933 | Thompson | 173/259 |
| 1,921,840 | 8/1933 | Recen | 173/259 |
| 1,960,593 | 5/1934 | Olson | 173/259 |
| 2,077,522 | 4/1937 | Heatwole | 173/259 |
| 2,195,900 | 4/1940 | Orahood et al | 173/259 |
| 2,222,577 | 11/1940 | Thompson | 173/259 |
| 2,360,974 | 10/1944 | Perreca | 173/259 |
| 2,434,398 | 1/1948 | Daellenbach | 173/259 |
| 2,462,453 | 2/1949 | Akin | 173/259 |
| 2,602,105 | 7/1952 | Welch et al | 173/259 |
| 2,751,571 | 6/1956 | Colyer | 339/228 |
| 2,769,964 | 11/1956 | Lartz | 339/226 |
| 2,846,660 | 8/1958 | Bogardus, Sr | 339/225 |
| 2,865,012 | 12/1958 | Black | 339/228 |
| 2,962,689 | 11/1960 | Johnson et al | 339/95 |
| 3,000,998 | 9/1961 | Wiora | 136/135 |
| 3,004,239 | 10/1961 | Devino | 339/226 |
| 3,383,646 | 5/1968 | Otto | 339/226 |
| 3,389,368 | 6/1968 | Schaefer | 339/116 |
| 3,568,139 | 3/1971 | Delzer | 339/239 |
| 3,704,440 | 11/1972 | Bradley | 339/114 |

UNITED STATES PATENT AND TRADEMARK OFFICE

CERTIFICATE OF CORRECTION

PATENT NO. : 5,087,214

DATED : February 11, 1992

INVENTOR(S) : JOHN H. DEWAR

It is certified that error appears in the above-identified patent and that said Letters Patent are hereby corrected as shown below:

U.S. PATENT DOCUMENTS (continued)

| | | | |
|---|---|---|---|
| 3,918,787 | 11/1975 | Hays | 339/19 |
| 3,963,303 | 6/1976 | Hays | 339/237 |
| 3,980,387 | 9/1976 | Neidecker | 339/228 |
| 4,054,355 | 10/1977 | Kourimsky et al | 339/230 |
| 4,062,613 | 12/1977 | Tritenne | 339/95B |
| 4,063,794 | 12/1977 | Dittmann | 339/230 |
| 4,294,505 | 10/1981 | Gaffney | 339/231 |
| 4,354,726 | 10/1982 | Kato et al | 339/230 |
| 4,372,636 | 2/1983 | Dufresne | 339/237 |
| 4,380,291 | 4/1983 | Shannon | 206/343 |
| 4,455,059 | 6/1984 | Theiler | 339/224 |
| 4,464,008 | 8/1984 | Andersson et al | 339/226 |
| 4,560,629 | 12/1985 | Woodhouse | 429/184 |
| 4,747,793 | 5/1988 | Fukuda et al | 439/766 |
| Des. 249,944 | 10/1978 | Smith | D13/24 |
| Des. 284,184 | 6/1986 | Carey et al | D13/10 |

Under "FOREIGN PATENT DOCUMENTS", add the following:

| | | | |
|---|---|---|---|
| 1288001 | 9/1972 | United Kingdom | 439/762 |
| 2054984 | 2/1981 | United Kingdom | 439/762 |
| 55-124768 | 9/1980 | Japan | 439/762 |
| 55-161359 | 11/1980 | Japan | 439/762 |

UNITED STATES PATENT AND TRADEMARK OFFICE
CERTIFICATE OF CORRECTION

PATENT NO. : 5,087,214

DATED : February 11, 1992

INVENTOR(S) : JOHN H. DEWAR

It is certified that error appears in the above-identified patent and that said Letters Patent is hereby corrected as shown below:

"FOREIGN PATENT DOCUMENTS" (Continued)

| | | | |
|---|---|---|---|
| 3-8064 | 2/1991 | Japan..... | 439/762 |
| 56-82875 | 7/1981 | Japan..... | 439/762 |
| 56-106364 | 8/1981 | Japan..... | 439/762 |
| 62-9364 | 1/1987 | Japan..... | 439/762 |
| 62-12264 | 1/1987 | Japan..... | 439/762 |
| 62-25466 | 2/1987 | Japan..... | 439/762 |
| 62-54465 | 4/1987 | Japan..... | 439/762 |
| 62-198666 | 12/1987 | Japan..... | 439/762 |
| 62-200246 | 12/1987 | Japan..... | 439/762 |
| 63-109442 | 7/1988 | Japan..... | 439/762 |
| 63-109443 | 7/1988 | Japan..... | 439/762 |
| 58-21480 | 5/1983 | Japan..... | 439/762 |
| 58-16140 | 4/1983 | Japan..... | 439/762 |
| 3-3957 | 1/1991 | Japan..... | 439/762 |
| 3-17403 | 4/1991 | Japan..... | 439/762 |
| 3-16214 | 4/1991 | Japan..... | 439/762 |
| 3-17404 | 4/1991 | Japan..... | 439/762 |
| 2-74762 | 6/1990 | Japan..... | 439/762 |
| 2-115249 | 9/1990 | Japan..... | 439/762 |
| 57-56453 | 12/1982 | Japan..... | 439/762 |
| 59-228358 | 12/1984 | Japan..... | 439/762 |

UNITED STATES PATENT AND TRADEMARK OFFICE

CERTIFICATE OF CORRECTION

PATENT NO. : 5,087,214

DATED : February 11, 1992

INVENTOR(S) : JOHN H. DEWAR

It is certified that error appears in the above-indentified patent and that said Letters Patent is hereby corrected as shown below:

"FOREIGN PATENT DOCUMENTS" (Continued)

| | | | |
|---|---|---|---|
| 56-21365 | 2/1981 | Japan | 439/762 |

Signed and Sealed this

Eighth Day of March, 1994

Bruce Lehman

*Attest:*

BRUCE LEHMAN

*Attesting Officer*

*Commissioner of Patents and Trademarks*